United States Patent [19]

Erickson

[11] 3,992,209

[45] Nov. 16, 1976

[54] IMAGEWISE DISTRIBUTION OF SULFATE GROUPS ON SUBSTRATE POLYMER BY PHOTOGRAPHIC TECHNIQUES

[75] Inventor: Floyd B. Erickson, Webster Groves, Mo.

[73] Assignee: Monsanto Company, St. Louis, Mo.

[22] Filed: May 29, 1975

[21] Appl. No.: 581,983

Related U.S. Application Data

[62] Division of Ser. No. 405,215, Oct. 10, 1973, Pat. No. 3,897,255, which is a division of Ser. No. 190,337, Oct. 18, 1971, Pat. No. 3,801,320.

[52] U.S. Cl. ..... 96/67; 96/48 R; 96/87 R; 96/115 R

[51] Int. Cl.[2] ..... G03C 1/76

[58] Field of Search ..... 96/67, 48 R, 48 HD, 96/115 R, 115 P, 88, 87, 89; 204/159.23, 159.24, 162; 260/314

[56] References Cited

UNITED STATES PATENTS

| | | | |
|---|---|---|---|
| 2,410,644 | 11/1946 | Fierke et al. | 96/65 |
| 2,437,412 | 3/1948 | Weyerts et al. | 96/65 |
| 2,950,237 | 8/1960 | Sharp | 204/158 |
| 2,951,800 | 9/1960 | Sharp | 204/162 |
| 3,085,897 | 4/1963 | Priest et al. | 96/30 |
| 3,097,096 | 7/1963 | Oster | 96/30 |
| 3,679,422 | 7/1972 | Muriac et al. | 96/48 HD |
| 3,684,511 | 8/1972 | Weyde et al. | 96/48 HD |
| 3,692,526 | 9/1972 | Ulbing | 96/48 HD |

*Primary Examiner*—Edward C. Kimlin

[57] ABSTRACT

This invention concerns a photoimaging procedure in which the image is characterized by a differential concentration of sulfate groups, depending upon the degree of light exposure, and is developable by selective absorption of dyes and other procedures. The sulfate groups can be obtained by $SO_2$ treatment of hydroperoxy groups produced in a photooxidation imaging procedure.

1 Claim, No Drawings

IMAGEWISE DISTRIBUTION OF SULFATE GROUPS ON SUBSTRATE POLYMER BY PHOTOGRAPHIC TECHNIQUES

This application is a division of my application Ser. No. 405,215 filed Oct. 10, 1973, now U.S. Pat. No. 3897255, which in turn is a division of my application Ser. No. 190,337, filed Oct. 18, 1971 and issued as patent 3,801,320 on Apr. 2, 1974.

the present invention is concerned with photoimaging and relates to photosensitive surfaces useful in photography and photocopy reproduction processes.

In the graphic arts industry represented by photography, photoengraving, photolithography, collotype, etc. silver halides and diazo compounds have been used as photosensitive materials to absorb energy from the light spectrum in processes for making photographic images and in reprography. Such photosensitive agents have usually required close control of chemicals used, time and amount of treatment to develop the images of objects replicated on the surface by exposure of the object to the photosensitive surface in the light spectrum. Such processes are both expensive and impractical, however, when it is desired to prepare numerous copies or replicas of an object or image on an inexpensive surface such as a cellulosic web for example cellulosic films, paper sheets and boards, and closely woven cellulosic textiles. In addition, the chemicals often used to develop and fix the silver halide or diazo photosensitized surfaces often need close temperature and concentration control, or the use of water solutions to effect acceptable reproduction on the photosensitized surface.

It is therefore desirable to find photosensitive materials and substrates which can be placed on smooth surfaces to effect simple, inexpensive photoreproduction of imges exposed thereon without the need for special facilities such as dark rooms, and for extensive controls on time of exposure to light, developer type, or concentration.

It has recently been found, as described in patent applications referred to hereinbelow, that substrates, particularly polymeric substrates, can be photoimaged so as to have chemical groups, i.e. hydroperxy groups, suitable for development of visible images, and that the photosensitive surfaces and procedures involved can be used directly for replica or image reproduction nd copy work.

SUMMARY OF THE INVENTION

It has now been found that latent images can be composed of materials containing differential distributions of non-migrating sulfate groups and that such images can be developed to form visible images. The latent image can be rendered visible by various techniques dependent upon differences in properties occasioned by the presence of such groups.

In general it is preferred that the sulfate groups be present as substituents attached to polymer structures, although sufficient stability as to location can be obtained by attachment to other coating or film layer materials. Such sulfate substituents can conveniently be obtained by conversion of image-forming hydroperoxy substituents to sulfate groups. Procedures for effecting imagewise formation of hydroperoxy groups in unsaturated materials, especially in ethylenically unsaturated polymers, are taught in a copending application of Robert A. Heimsch and Eric T. Reaville, Ser. No. 644,121 filed June 7, 1967, and a continution-in-part thereof Ser. No. 115,727, filed Feb. 16, 1971, and any of the procedures of the aforesaid applications can be utilized in preparing the sulfate-group imges in accordance with the present invention. In general the imagewise formation of hydroperoxy groups is accomplished by imagewise exposure to light of an unsaturated substrate in the presence of an oxidation photosensitizer and light. The resulting latent image can then be treated with $SO_2$ to cause conversion of hydroperoxy groups to sulfate groups.

In one aspect the invention involves the use of sulfur dioxide for treatment of the image after exposure. In another aspect, the sulfur dioxide can be used to treat the coating or components thereof before exposure. The sulfur dioxide can, for example, be incorporated into a solution with the photosensitizer, apparently forming an adduct or complex with porphyrin sensitizer. If the sulfur dioxide is used to directly treat the photosensitive coating before exposure, it may complex with the sensitizer in such coating or otherwise remain in the coating to have a subsequent effect upon hydroperoxy groups. It is to be understood that materials which generate or provide $SO_2$, as well as $SO_2$ itself, can be used for the $SO_2$ treatments or reactions herein.

The present invention involves use of a photosensitive layer containing carbon-to-carbon double bond unsaturation in the photoimaging procedure. Such layers are capable of undergoing oxidation reactions under the influence of light to effect a change in properties which can produce a latent image which is subject to development and treatment as taught herein. The photosensitive layer should be relatively stable in form to prevent undue migration of compounds containing the unsaturated group, if such compound should be of relatively low molecular weight or liquid. Ordinarily any film-forming materials will provide a stable matrix to prevent migration of the sulfate substituents with polymeric materials generally being used. Of course, some of the layer materials disclosed herein have both the unsaturated groups and the properites for forming stable films or coatings e.g. high molecular weight polymers containing residual unsaturation, such as styrene/butadiene copolymers. Thus in general there will be no need for using separate binder materials, but the use of such are fully consonant with the present invention. Even though a particular polymer in itself has all the properties necessary to serve as a photosensitive substrate, it may nevertheless also be used in conjunction with other polymeric binder materials which do not have unsaturated groups, or in conjunction with other materials which do have such groups.

Photooxidation photoimaging is convenient for use in the present invention because of versatility, convenient workability, and various other features of such procedures as pointed out in the present application. In such procedures the various layer materials containing unsaturation referred to herein can be employed. Any of the materials disclosed in the aforesaid applications Ser. No. 644,121 and (C-11-21-0189) can be employed. The photooxidizable layer may be any natural or synthetic material containing suitable carbon-to-carbon unsaturation, which material is spreadable on a suitable base support such as a glass or metal plate, a plastic solid or sheet, or a paper sheet or board surface, etc. and is sufficiently non-volatile at the temperature used. For use of this invention at ordinary room temperature the substrate material should have a molecular weight above about 140 so that it will not be removed from the surface or from the reaction site by migration in the oxidized form or by evaporation from the treated surface. The photooxidizable substrate may contain the suitable carbon-to-carbon unsaturation as part of its structure or molecules containing suitable carbon-to-carbon unsaturation may be added thereto. Higher molecular weight polymers or other materials may be used as a binder for low molecular weight materials containing the unsaturation to provide a suitably stable layer or film for imaging.

Natural materials which may be used in photooxidation include rosin and the double bond containing components thereof, terpenes such as abietic-acid, neoabietic acid, maleopimaric acid, levopimaric acid, α-pinene, camphene, 3-carene, citronellol, aldehyde modified rosin materials such as formaldehyde modified rosins, and fortified rosin materials such as those obtained by recting the rosin with alpha, beta-olefinically unsaturated polycarboxylic acids and anhydrides thereof, and partial and complete esters of such acids as maleic acid, fumaric acid, itaconic acid, aconitic acid, citraconic acid, etc., both saponified or unsaponified with an alkaline material. Other examples include the use of unsaturated fatty oils either in the glyceride ester form or in the free acid form. A few examples of such oils include olive, peanut, almond, neat's foot, pecan nut, lard, tung, safflower, cottonseed and soybean oils. Non-glyceride source unsaturated oils such as tall oil may also be used.

Unsaturated hydrocarbons of natural and synthetic origin may also be used in photooxidation. Examples of such materials include the aliphatic olefinically unsaturated hydrocarbons having an average of at least about 10 carbon atoms, e.g. 1-dodecene, 1-tridecene, 1-tetradecene, 1-pentadecene, 1-hexadecene, 1-docosene, 1-pentacosene and the internally unsaturated olefins such as 7-heptadecene, 7,10-heptadecadiene, etc. the aromatic olefinically unsaturated hydrocarbons in the unpolymerized form such as isopropenyl toluene, phenylisobutene, phenylhexadiene and isopropenyl naphthalene.

Natural and synthetic polymeric materials containing unreacted carbon-to-carbon double bonds therein may also be used as the photooxidizable substrate material in practicing this invention. The carbon-to-carbon unsaturation may be intralinear, e.g. $CH_2—CH=CH—CH_2—$, a vinylene linkage, terminal, e.g.

$$—CH_2—CH=CH_2 \text{ vinyl, } CH_2=C\begin{matrix}CH_2\\CH_2\end{matrix}$$

vinylidene and the like. Attached groups to the aforedescribed entities may be linear or branched. In general, the polymeric backbone will be hydrocarbon in structure with any halide, ester, ether, hydroxyl, nitrile, phenyl or other group present in the polymer molecule appended to the polymeric backbone.

It will be understood that the vinyl compounds are a species of vinylidene compounds since they contain the characteristic $CH_2=CH—$ group, the indicated free carbon valence being satisfied by another atom in the polymr molecule. The term "vinylidene" is used herein to include both vinylidene and vinyl unsaturation.

Illustrative examples of these olefinically unsaturated polymers useful in photooxidation include natural rubbers; homopolymers, copolymers, and polymers from three or more monomers, prepared from diolefins such as butadiene, isoprene, 2,3-dimethyl-1,3-butadiene, piperylene, chloroprene, bromoprene, 2-acetoxybutadiene-1,3, 2-methyl-pentadiene, 2-ethylhexadiene; and polymers prepared from diolefins such as those aforementioned and compounds containing a vinyl or a vinylidene group such as a. Vinyl ether, e.g. vinyl alkyl ethers such as vinyl ethyl ether, vinyl butyl ether, vinyl octyl ether, vinyl dodecyl ether, vinyl tetradecyl ether, vinyl hexadecyl ether, vinyl octadecyl ether and vinyl alkenyl ethers, e.g. vinyl ether, vinyl octenyl ether, vinyl tetradecenyl ether, vinyl octadecenyl ether;

b. Vinyl esters, e.g. vinyl acetate, vinyl butyrate, vinyl caprylate, vinyl caprate, vinyl laurate, vinyl myristate, vinyl palmitate, vinyl stearate;

c. Vinyl halides, e.g. vinyl chloride, vinyl bromide;

d. Vinyl ketones, e.g. vinyl methyl ketone;

e. Vinyl sulfides, sulfoxides and sulfones, e.g. vinyl ethyl sulfide; vinyl propyl sulfoxide, vinyl tert-butyl sulfone;

f. Vinylidene compounds, e.g. vinylidene chloride;

g. Acrylic, methacrylic acids or crotonic acids and their derivatives, e.g. acrylic acid, acrylonitrile, methacrylamide, crotonamide;

h. Acrylic, methacrylic esters or crotonic esters, e.g. methyl methacrylate, ethyl acrylate, propyl acrylate, amyl acrylate, heptyl acrylate, octyl methacrylate, nonyl acrylate, undecyl acrylate, tetradecyl acrylate, hexadecyl acrylate, octadecyl acrylate, ethenyl acrylate, hexenyl methacrylate, dodecenyl acrylate, octadecenyl acrylate, ethyl crotonate;

i. Allyl ester, e.g. allyl acetate, allyl butyrate, allyl caprylate, ally caprate, ally laurate, allyl myristate, allyl palmitate, allyl stearate;

j. Allyl alkyl ethers, e.g. allyl ethyl ether, allyl octyl ether, allyl dodecyl ether, allyl tetradecyl ether, allyl hexadecyl ether, allyl octadecyl ether, and vinyl alkenyl ethers, e.g. allyl ethenyl ether, allyl octenyl ether, allyl tetradecenyl ether, allyl octadecenyl ethers;

k. Cycloaliphatic vinyl compounds, e.g. vinyl cyclohexane;

l. Aryl vinyl compounds, e.g. styrene, vinyltoluene, vinylbiphenyl, vinyl naphthalene and the ar-chloro substituted styrenes;

m. Meterocyclic vinyl compounds, e.g. vinyl pyridine and vinyl dihydropyran;

n. Alpha-olefins, e.g. ethylene, propylene, butene-1, octene-1, dodecene-1, tetradecene-1, hexadecene-1 and heptadecene-1, dichloroethylenes, tetrafluoroethylene; and o. Branched olefins, e.g. isobutylene, isoamylene, 2,3,3-trimethyl-1-butene.

It is to be understood that the unsaturated polymers which are used in the practice of this invention can also be prepared by copolymerization of two or more different diolefins, e.g. from a mixture of butadiene and piperylene, either in the presence or absence of one or more non-dienic copolymerizable monomers.

The physical characteristics of the olefinically unsaturated polymers which can be photooxidized in accordance with the present invention may vary from low molecular weight polymer oils containing relatively few olefinic bonds to high molecular weight rubbers and resins such as those resulting from the polymerization or copolymerization of diolefins in the presence or absence of one or more non-dienic copolymerizable monomers.

The photoimaging by photooxidation and $SO_2$ treatment utilized in the present invention depends upon the change in properties caused by substitution of sulfate groups on molecular structures of the photosensitive substrate, and appears to a considerable extent to be due to the polarity of sulfate groups in such molecules. The procedure makes possible differentially profound point-by-point property changes in a film due to differential distribution of non-migrating sulfate accurately reproduces the intensity of light to which each differential area was exposed and the difference in chemical and physical properties of the sulfated regions compared to the non-exposed regions results in a latent image which can be rendered visible by difference in dye sorption, solubility, surface tack or other properties. For the differences caused by the sulfation to be most evident, it is desirable that the original photosensitive composition not have groups with properties similar to sulfates, although some such groups can be tolerated, even though contributing to an objectionable background in some photoimaging procedures. Such polar groups as carboxy, hydroxyl, nitrile, etc. may mask the photoimaging effect of hydroperoxy groups to some extent. For this reason some of the preferred polymers for use herein are hydrocarbon polymers with residual unsaturation, e.g. styrene/butadiene copolymerds, etc. However, for the effect upon the original solvent solubility, or upon mechanical film properties it may at times be desirable to use polymers having various substituents, such as halogen, nitrile, carboxyalkyl, etc. and polymers containing such substituents can be used if some loss in photoimaging sensitivity can be tolerated in the particular application in view. In general it will be preferred that polar monomers not constitute more than three-fourths of the monomer content of a copolymer used as the photooxidizable substrate in the present invention.

Aside from characteristics of the photosensitive compositions for forming latent photoimages in accordance herewith, various other mechanical or other properties of the polymers will have significance with respect to ease of coating application, durability and handling properties of the film, but in general those skilled in the art will be able to select appropriate materials for particular applications, particularly in view of the present disclosure.

In general solid polymers having carbon-to-carbon double bonds with allylic hydrogen adjacent thereto are suitable for photooxidation use herein. Such polymers will preferably be substantially linear and have a weight average molecular weight of at least 50,000, and at least one such carbon-to-carbon double bond for about every fifty carbon atoms; a more limited class of such polymers are hydrocarbon in structure to avoid possible adverse effects of polar or other substituents.

Photosensitizers used herein for catalyzing the preferred photooxidation type of reaction are referred to generally as being of the porphyrin type. The porphyrin type of photosensitizer may be described as any compound having the porphin structure, i.e. four pyrrole rings connected by single carbon or nitrogen atoms, which includes related compounds such as the porphyrazines, phthalocyanines or chlorophylls.

Particular photosensitizers useful in practicing photooxidation in the present invention are the aromatic group meso-substituted porphyrin compounds. Among such aromatic substituted porphins are the ms-tetraarylporphins (ms-meso). These compounds are those porphins in which aryl groups having from 6 to 24 carbon atoms are substituted on the bridging carbon atoms of the porphin ring structure which contains four pyrrole nuclei linked together in a circular pattern by four bridging carbon atoms to form a great ring. Examples of aryl groups which may be substituted in the meso-position of these compounds are phenyl, chlorophenyl, dichlorophenyl, methylphenyl, N,N-dimethylaminophenyl, hydroxyphenyl, naphthyl, biphenyl, anthracyl, phenanthryl, etc. In addition to the substituents in the aryl group substituents noted above, the aryl groups can also have any or a combination of such substituents, e.g. as alkyloxy (1 to 20 carbon atoms) substituents such as methoxy, ethoxy, isopropoxy, butoxy, hexyloxy, etc., as well as other substitutents, particularly those which do not change the fundamental aromatic character of the groups. These porphin sensitizers including the above exemplified aryl-porphins, can have various other substituents, particularly at the beta and beta′ positions of the pyrrole rings, e.g., such substituents as lower alkyl (1–20 carbon atoms) such as vinyl or allyl or alkanoic acid groups such as methylcarboxy or ethylcarboxy.

Examples of porphin compounds which are useful as photochemical sensitizers in practicing this invention are the arylporphins such as the tetraphenyltetrazoporphins and the complexes thereof, such as diamagnetic complexes, e.g., magnesium tetraphenyltetrazoporphin, tetraphenyl tetrazoporphin acetate, tetraphenyltetrazoporphin sulfate, zinc tetraphenyltetrazoporphin; the meso-aryl porphins including alpha, beta, gamma, deltanaphthylporphin, and the diamagnetic metal chelates thereof, e.g.

tetraphenylporphin
tetrakis(2,4-dichlorophenyl)porphin
tetrakis(tetrakis(2-furyl)porphin
tetrakis(4-methoxyphenyl)porphin
tetrakis(4-methylphenyl)porphin
tetrakis(2-thienyl)porphin
tetraphenylporphin zinc complex
tetrakis(4-nitrophenyl)porphin
tetrakis(4-dimethylaminophenyl)porphin zinc complex;

the tetrabenzomonoazo- and tetrabenzodiazo porphins, the 1,2,3,4,5,6,7,8-octaphenylporphins and azoporphins such as octaphenylporphyrazine, the tetrabenzoporphins, e.g. tetrabenzoporphin and the zinc complex of tetrabenzoporphin.

Other useful porphin types of photosensitizing materials which may be used include chlorophyll, such as chlorophyll a and chlorophyll b, hemin, the tetrazoporphins, chlorophyllin salt derivatives such as the reaction product of an alkaline metal chlorophyllin salt and sodium bisulfite, hematoporphin, mercury proto- and hemato-porphins; vitamin $B_{12}$ and its derivative tetrakis(1-naphthyl)porphin, porphin, ms-tetramethylporphin, ms-tetraethylporphin and other ms-alkyl and alkoxy porphins.

Related porphin type materials which may be used include the phthalocyanines including the metal-free phthalocyanine and metal complexes of phthalocyanine such as the zinc and magnesium, complexes of phthalocyanine, as well as phthalocyanine derivatives such as the barium or calcium salts of the phthalocyanine sulfonic acid, acetylated phthalocyanine, alkoxy- and aryloxy-benzo-substituted phthalocyanines, 5,5′, 5″, 5‴-tetraamino-metal phthalocyanine-4,4′,4″,4‴-tetrasulfonic acid; magnesium tetra(4)methylthiophthalocyanine, arylthioethers of phthalocyanines, vinyl group containing tetraazoporphyrins and polymers thereof, mercaptoamino phthalocyanine derivatives and phthalocyanine.

Other useful photosensitizers which can be used include fluorescein type dyes and light absorber materials based on a triarylmethane nucleus. Such compounds are well known and include Crystal Violet, Malachite green, Eosin, Rose Bengal and the like.

Another group of photosensitizers particularly useful in the ultraviolet region include the aromatic compounds such as acetophenone, benzophenone, benzoin, benzil and triphenylene.

Light necessary in the practice of this invention can vary considerably in wave lengths, depending on the sensitizer in this system. The light can be monochromatic or polychromatic. Light of wave lengths in the range of 3600 to 8000 Angstroms has been found very suitable.

Light sources suitable for use in the practice of this invention include carbon arcs, tungsten and mercury-vapor arcs, fluorescent lamps, argon glow lamps, electronic flash units, photographic flood lamps and sunlight.

The present invention is particularly concerned with imaging procedures utilizing photosensitized oxygen transfer reactions in which light in the presence of a sensitizer causes the oxygen to oxidize the carbon-to-carbon unsaturated substrate by being added to one carbon atom of a double bond with shift of the double bond to the adjacent position and movement of the allylic hydrogen atom to the oxygen atom of the oxygen molecule which is not attached to the carbon atom. The reaction can be postulated:

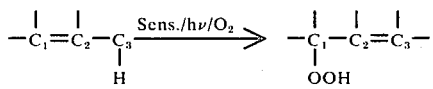

The aforesaid oxygen transfer reaction does not include autooxidations, proceeding by a free radical mechanism in which irradiation with light serves to initiate free radicals and cause the formation of free radical sites in the substrate by hydrogen abstraction. The true photosensitized oxidation or oxygen transfer reactions used herein are characterized by the fact that they can proceed using wavelengths of light which may be ineffective for autooxidation and by the fact that in general ordinary oxidation inhibitors do not retard the reaction.

The photosensitized oxygen utilized herein involves what is referred to by Gollnick and Schenck (K. Gollnick and G. O. Schenck, Pure and Applied Chemistry, Vol. 9, 507 [1954]) as a Type 2 reaction, or "photosensitized oxygen transfer." The reaction involves some excited oxygen species, whether pictured as an oxygen molecule itself in an excited singlet state, or an excited sensitizer-oxygen adduct. Irradiation with light appears to transform the sensitizer to an excited state, such as a triplet state:

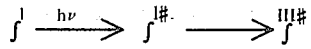

The sensitizer then transfers its energy to oxygen. This can be postulated as

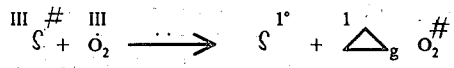

and the excited singlet delta oxygen can then add to the double bond as pictured above. It should be understood that if the triplet energy of the sensitizer is above 37 keal singlet sigma oxygen may also be produced. It may react directly or decay to the lower energy delta species. The reaction involves light energy to excite the sensitizer and produce an excited state oxygen which reacts with the substrate to cause addition of oxygen to one of the doubly-bonded carbons thereof. The reaction ordinarily does not include any chain propagation, but only one oxygen addition per photon absorbed at quantum yield of unity. The photosensitized reaction can proceed using wave lengths of light other than ultraviolet, and ordinary oxidation inhibitors do not inhibit the reaction. A sensitizer-oxygen adduct is presumably formed but is apparently short-lived; however it should be understood that the oxidation is effective regardless of what the mechanism and exact contribution of the adduct to the oxidation of the olefin may be.

In another aspect, the present invention can utilize an oxidation reaction in whih a hydrogen atom is abstracted to give a radical and oxygen is then added. For example the Type 1 reaction in the foregoing Gollnick and Schenck article involves a reaction in which the allylic hydrogen atom at C-3 is abstracted to give a mesomeric mono-radical

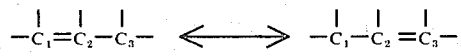

and oxygen is then attached at either of radical sites $C_1$ or $C_3$, and the peroxyradicals thus formed extract hydrogen from the C-3 position of the olefin to give hydroperoxides and a new mesomeric radical, thus permitting chain propagation. Sensitizers which are voracious hydrogen abstractors when excited by light energy are suitable for use in such reaction. One group in such a class is the carbonyl compounds, as for example, benzophenone, acetophenone, etc. Aside from olefins containing allyl hydrogen, other types of materials containing labile hydrogen can undergo reactions similar to that of Type 1 to produce materials containing hydroperoxy groups, and such materials can be used for photoimaging in accordance with this aspect of the invention, for example, such materials as ditetrahydrofurfuryl phthalate, di-2-ethylhexyl phthalate, compounds containing tertiary hydrogen, etc. If such materials are liquid they will generally be used in conjunction with a polymer or some other high molecular weight binder to provide a suitable matrix. In oxidations involving abstraction of labile hydrogen to generate free radicals, other reactions such as crosslinking can also occur and may interfere with the desired photoimaging reaction, and such oxidations, while usable in the present invention and useful to some extent, are not in accord with the preferred aspects of the present invention.

Sensitizers which can function in both Type 1 and Type 2 reactions include benzophenone, acetophenone, benzil, benzoin, etc. These carbonyl type sensitizers require ultraviolet light of suitable wave length for excitation. Sensitizers which also function in both Type 1 and Type 2 reactions, but are active in the visible region as well as the ultraviolet region of the spectrum include eosin, fluoroescein, rose bengal, etc. Sensitizers which are not hydrogen abstracters and which function largely or wholly by energy interchange as in Type 2 reactions, include the various porphyrin type photosensitizers. In general photosensitizers capable of Type 2 sensitization are much preferred, and ordinarily the better ones of this Type are not very effective as Type 1 photosensitizers. Moreover, the absence of Type 1 activity may make it easier to minimize side reactions. There will be variations in the effectiveness of sensitizers with the physical type of phase involved and it will be understood that the sensitizers utilized herein will be those effective under the conditions of use. The sensitizers described above are known to function in liquid phase. In the practice of this invention some systems have involved the post-application of a sensitizer solvent system to an already pre-formed film. The resulting system can be called a quasi-solid phase as it consists of a solid polymer lightly swollen with a swelling solvent system. In such a quasi-solid phase, the sensitizers listed above and similar photosensitizers are found to effect photochemical addition of oxygen, although with great variation in effectiveness. In the practice of the invention it is also feasible to use solid phase systems in which the sensitizer has been incorporated into a polymeric film composition which has not been swollen by solvent. In the solid phase such sensitizers as rose bengal, fluorescein, eosin, methylene blue, etc. did not exhibit significant photoimaging capability in reasonable exposure times. Benzophenone, acetophenone, benzil, etc., were found to require high level of application, circa 10%, and prolonged exposure, circa 30 minutes at ultraviolet flux of $7 \times 10^5$ ergs/cm$^2$/sec. in order to show substantial photoimaging capability. In contrast to this, porphyrins, such as tetraphenyl porphin are very active at levels as low as 0.1% at a flux of $2.5 \times 10^5$ ergs/cm$^2$/sec. for 1 to 2 minutes. Triphenylene in the solid phase seems to function largely by crosslinking, making it of little value for continuous tone image production.

The photosensitizers can be placed in solid phase by incorporation into a coating solution, emulsion, melt, or suspension, etc. and application to support. After evaporation, drying, or othe means of removing volatile solvents or other liquid medium, the photosensitizer remains in the residual coating composition dispersed in solid form in the solid composition. Even if the photosensitizer is incorporated by post-application with a solvent, it can be converted to the solid state by permitting the solvent to evaporate. For ease of handling and reproducibility, it is preferred that the photosensitive compositions be dry at the time of photoimaging. It will be recognized that in referring to the photosensitizer as being in a solid medium, it is not meant to exclude such resilience, elasticity or other properties as may be desirable in photosensitive films for various purposes, and that plasticizers or low molecular weight materials may be present for such purposes. Thus the solid state contrasts with the quasi solid state in which liquid is present to swell the polymer structure as in a plastisol or organosol and to provide a liquid medium in which the photosensitizer can be present, aside from how much of the photosensitizer is actually present in such medium.

The photosensitizer as employed will generally be of a type suitable for producing a desired amount of oxygen addition in the particular photosensitive composition upon degrees of light exposure within ranges of practicality for some photoimaging applications. For most applications it will be desirable that a required energy absorption be no greater than $10^7$ ergs/cm$^2$, or possibly $10^8$ ergs/cm$^2$ in some applications, and preferred that such absorption be sufficient with a concentration of photosensitizer no greater than 1% by weight of the photosensitive composition, for example with a flux sufficient to obtain such absorption over a 2-minute exposure period. The energy required for imaging will generally lie in the range of 1 to $10 \times 10^6$ ergs/cm$^2$. Absorptions with usual imaging procedures are frequently of the order of $2.5 \times 10^4$ ergs/cm$^2$/sec. The foregoing energy ranges are those generally employed with the concentrations of photosensitizer generally used, but increasing the concentration makes it possible to use lower energy input for the photoimaging as the imaging requirements are approximtely in inverse proportion to the photosensitizer concentration. The use of various amplifying means also makes it possible to lower the energy requirements. In order to have practical value in a photoimaging system, a photosensitizer as used should produce an oxygen uptake of at least about $10^{-9}$ moles/cm$^2$ with an absorbed energy of $10^7$ ergs. A styrene-butadiene polymer (40 wt. parts styrene/60 wt. parts butadiene) film can suitably be used for determining oxygen uptake at particular energy absorptions.

Conversion of the hydroperoxy groups to sulfate groups can be considered an amplification technique. Thus the acidic sulfate groups are strongly polar and exert a stronger effect than hydroperoxy groups on most properties of the substrate upon which developability of an image depends. For this reason the exposures needed when $SO_2$ treatment is involved tend more toward the lower portion of the cited ranges than is the case when only hydroperoxy groups are involved.

Only a portion of the applied light flux will be absorbed by the photoimaging substrate, with that portion varying with the absorption characteristics of such substrate, as well as with the wave length of the light. Absorptions may, for example, be less than 10%, or of the order of 7% in some cases. Visible light can effectively be used in the present invention, and this is a definite advantage as it avoids the cost and loss in efficiency which results from having to produce light in particular ranges, such as the ultra violet range. In the present invention it is not necessary to utilize the ultra violet range, and in fact, the range of 4000 to 4500 angstroms appears most efficient. If desired, light in ranges above 4000 angstroms can be used to avoid possible ultra violet catalysis of competing reactions, although this is not ordinarily necessary. While visible light is effective, the present materials can generally be handled in ordinary daylight, such as by removing the photosensitive material from the intense light used for exposure, and carrying out development or other steps without special precaution to avoid further exposure to ordinary ambient light.

The preferred sensitizers for use herein belong to the class of porphyrins which are compounds with pyrrole rings linked together by carbon atoms to form a conjugated double bond structure, and in which one or more of the carbon atoms, i.e. methine groups, can be replaced by a nitrogen atom, and which class also includes the phthalocyanines and benzoporphyrins, as well as the meso-arylporphyrins, or other compounds having various substituents on the basic porphyrin structure. The tetraaryl porphyrins, particularly tetraphenyl porphyrin, are characterized by the capability we utilize energy from three of the main areas of the visible light spectrum, i.e. the violet, yellow and red areas and therefore to make efficient use of light energy. Such sensitizers can be termed panchromatic photooxidation sensitizers and are particularly valuable. Some other sensitizers are active only in limited areas of the spectrum, for example chlorophyll absorbs mainly in the red region. Aside from efficiency, the panchromatic sensitizers are advantageous for multicolor work in that it makes it possible to use a single sensitizer for exposures to reproduce different colors from an original, rather than having to change sensitizers for each of the main segments of the color spectrum. Tetraphenyl porphyrin absorbs most strongly in the violet, and less in the yellow and least in the red, which is advantageous in that visible light is the reverse, being strong in the red, etc., and therefore the sensitizer compensates for the variation in light-intensity and tends to equalize the effect of different intensities. Utilizing the panchromatic sensitizers, the present invention produces images from multi-color transparencies. If polychromatic light is used with a single exposure, the resultant image will not ordinarily exhibit appreciable differentiation between the colors, but the image produced will have parts corresponding to the various colors. The image can be developed by applying a single dye to give a monochromatic image e.g. red and white, or by using a solvent to remove areas either corresponding to the colored regions or the non-colored regions.

The sulfate materials used herein are materials having sulfate groups, $$>SO_4,$$

chemically bonded thereto. Such groups can be represented as $-OSO_3M$, where the oxygen bond is generally to a carbon atom of a substrate material, and M represents hydrogen, metal, or other moiety capable of forming a salt with the sulfate anion. It will be recognized that the sulfate group has ionic character, so the group can also be represented as $-OSO_3\text{-}M^+$ M can, for example, be such ions as hydrogen, sodium, potassium, ammonium, ethyl ammonium, dimethylammonium, trimethylammonium, tetraethylammonium, etc., as well as polyvalent cations such as calcium, aluminum, etc. In the case of polyvalent cations, the number of sulfate groups will be such as to balance the valence of the cation, e.g., to sulfate groups for one calcium ion. It is also feasible to use partially neutralized cations effectively as monovalent cations, e.g. to use $$^{+}CaOC(=O)CH_3.$$

Ordinarily the present invention will employ the $-OSO_3H$ groups which is readily obtained in accord with procedures taught herein. However, at some stages of development or for other reasons it may be desirable to neutralize the acidic sulfate group, and this can conveniently be done by general procedures for neutralizing sulfate or other acidic groups. Ammonia, being a volatile base, can be conveniently used for such purpose and converts the sulfate groups from hydrogen sulfate groups to ammonium sulfate groups. It will be recognized that the cation will have an influence upon solubility properties, and that some neutralization procedures may effect development by washing away portions of the coating as taught herein.

With the unsaturated polymers and the photoimaging procedures utilized herein, the imaged coatings will be characterized by the presence of groupings represented by $$-\underset{\underset{OSO_3M}{|}}{C}-C=C-\ .$$

However, the illustrated double bond does not have a marked effect upon properties ordinarily utilized for development of the images, and the presence of such unsaturation is not essential as the sulfate groups give the desired properties for developing visible images, regardless of whether the unsaturation is present. Thus the photoimaging procedures are effective even if some or all of the unsaturation is lost in the photoimaging, or if a method of obtaining the imagewise distribution of sulfate groups does not utilize an unsaturated polymer as a starting point.

It will also be recognized that the procedures herein for converting hydroperoxy groups to sulfate groups need not convert all hydroperoxy groups, and are unlikely to give 100% conversion in all cases. Thus the photoimages will often involve the differential distribution of both hydroperoxy and sulfate groups. As the response of these groups to various development procedures is similar, the development procedures taught herein can suitably be employed with latent images in which both groups are present. It is advantageous that the sulfate group be firmly bound to a large polymer moiety in order to have a stable location. However, it is recognized that the sulfate group is reactive, and potential reactions may involve rupture of the bond to the polymer.

In converting hydroperoxy groups to sulfate groups in the present invention, any methods effective to achieve such conversion can be employed. Peroxy groups readily react with sulfur dioxide to produce sulfate groups. It is generally convenient to employ sulfur dioxide gas for such treatment. However, any source of sulfur dioxide can be employed, including generation in situ. For example, an aqueous bath of meta bisulfite salts can be utilized to generate $SO_2$, and the peroxidized coating can be exposed to vapors over the bath. $NaHSO_3$ is convenient for use, but other bisulfite salts which ionize can be used. Solutions containing $SO_2$ can be used, although the effect of the solvent medium on the coating and support must then be considered, in accordance with the teachings herein concerning liquids for use in development by coating removal. Aqueous solutions containing or generating $SO_2$ can be used for direct treatment of the coatings, although this will have disadvantages when the coating is on a paper support and the strength and dimensional stability of such support are adversely affected by water. Treatment of the coatings with sulfolene, before or after exposure, or before or after development, produces substantially the same results as treatment with sulfur dioxide gas.

The sulfate containing photoimages will generally be produced by converting -OOH groups to sulfates. However, it is also contemplated that the hydroperoxy groups first be converted to alkali peroxy, e.g., sodium peroxy, groups or to other alkali or alkaline metal intermediates, and the latter then converted to sulfates through treatment with sulfur dioxide.

The latent sulfate-group containing photoimages can be developed in general by applying any of the development procedures taught in the aforesaid copending applications of Heimsch and Reaville for photooxidation images.

The dyes used in this invention to fix or develop the images defined by differential distributions of sulfate groups, as may be produced by photo-oxidation and sulfation, may be any dye which has varying affinities for sulfated and non-sulfated sites on the light exposed treated surface. Dyes generally found useful in this invention are the organic solvent or oil soluble dyes such as the kerosene or alcohol soluble dyes, e.g., the triphenylmethane type, azo dyes and disperse dyes. It has been found that dyes dissolved in a solvent such as deodorized or highly refined kerosene are directed generally to the non-sulfated portion of the exposed treated surface and that dyes dissolved in an alcohol such as 2-ethylhexanol are directed chiefly to the sulfated portions of the exposed treated surface. The particular site at which the dye locates itself appears to depend on the selective swelling characteristics of the solvent used, the effect of the dye on the solubility parameter of the solvent, and on the polarity of the dye. Although these factors appear to control the direction of the dye, the actual chemical or physical mechanism of the direction and image application brought by the dye is not fully understood.

The solvents or dispersants which are used for the dye may be any organic material which will (1) dissolve or disperse the dye and which will aid in selectively directing the dye to the sulfated or non-sulfated regions of the exposed treated surface so that the differences in sulfation in the various areas of the surface can be readily made apparent thereby. Suitable solvent or diluents for the dyes which can be used include low melting molten waxes, liquid alkanes, cycloalkanes, alkanes mixed with aromatic compounds such as benzene, toluene, xylene, chlorobenzene, etc., aliphatic fatty acids having from 6 to 24 carbon atoms, molten unsaturated fatty acids such as palmitic acid, higher liquid aliphatic alcohols having from 6 to about 20 carbon atoms, and such higher alcohols mixed with up to about 50% of lower alcohols, aliphatic esters which are liquid or low melting (below 100° C.) solids at room temperatures such as triacetin, ethyl hexanoate, methyl oleate. The dyes may be used in any desired concentration in the solvent or diluent but a solution containing about 0.1 to about 6 percent of dye by weight in the selected solvent is generally sufficient for most fixing or developing purposes of this invention. The dyes may also be applied as a solid.

Examples of dyes found in the Colour Index which are useful for amplifying or developing latent images produced with a positive image forming object, e.g., a typewritten opaque white sheet, include Sudan Brown, Sudan Red, or Calco Oil Red dissolved in deodorized kerosene. Examples of dyes useful for amplifying or developing latent images produced with a negative image forming object, e.g., a photographic negative film, include Crystal Violet, Malachite Green, Victoria Blue or Nigrosine B dissolved in 2-ethylhexanol.

The site to which the dye is directed depends both on the dye and the solvent. For example, Sudan Brown dissolved in kerosene goes preferentially to the non-sulfated site. A strongly basic dye like Crystal Violet goes preferentially to the sulfated sites. In some cases inversion appears to occur at sites of too high a degree of sulfation with the dye being rejected at such sites.

The dyes may be simply wiped on the exposed photooxidized element as with a rag, brush, or sprayed on or applied by other conventional methods, and then dried as by wiping the dye treated surface with a dry cloth or tissue. The result is a clear, useful print or copy of the object to be copied or reproduced. While various dyes are selective in that they absorb in differential concentrations in various exposed and non-exposed areas, it will be recognized that some dyes will absorb to some extent in areas other than those intended for development by such dye, and the acceptability of this depends upon the degree of absorption, compared to absorption in intended areas, and whether background color is objectionable in the particular application. Such effects can be regulated by control of exposure times and dye application procedures.

It will be recognized that the acidic sulfate groups can effect the color of some dyes, and this must be taken into account in the selection of dyes for image development. In general the solvents used herein for development by coating removal will be relatively poor solvents for the polymer substrate involved, as a selective removal is desired. For selective removal of non-exposed areas, solvents will be selected which are effective to soften or dissolve the nonexposed areas, but which are not sufficiently effective to remove exposed areas in which sulfate groups or other groups affecting solubility are present. Solubility parameters present a suitable guide for choosing appropriate solvents, although there will be some variance with individual members of such classes. Such parameters $\int$ based on cohesive energy density, are described in Solubility Parameters by Harry Burrell, Parts I and II, Interchemical Review, Vol. 14, No. 1, pages 3-16, and Vol. 14, No. 2, pages 31-46 (1955). As the sulfate groups increase the solubility parameter, the solvent will generally be selected to have a parameter slightly less than that of the polymer employed. Thus with a diene rubber having a solubility parameter around 8.5, a suitable solvent could have a solubility parameter less than 8, such as methylcyclohexane with a parameter of 7.8. Many of the hydrocarbon diene polymers suitable for use herein have solubility parameters in the range of 8 to 9.5, and accordingly, the developing solvents usually will have solubility parameters below 8, although higher parameters may at times be suitable. Many of the solvents suitable for use herein for removal of non-exposed areas will have solubility parameters in the range of 7 to 8 or Poorer solvents when used sometimes require longer development times, but this may not be objectionable in some applications. Aliphatic hydrocarbons, including cycloaliphatics, provide a number of suitable solvents for use with particular polymer systems, e.g., kerosene, VM and P naphthas, methylcyclohexane, octane, etc. Some aliphatic, i.e. non-benzenoid, unsaturation may be present in such solvents, but aromatic solvents may have too high a solubility parameter for use with the preferred polymer systems herein. Solvents such as benzene, toluene, etc. may dissolve both the exposed and non-exposed areas in a photooxidation imaging system. Thus it is not preferred to use really good solvents for the polymer for the development purposes, but to select solvents of lower solubility parameter than the polymer, e.g. 0.2 to 0.5 or more units lower. However, sulfate groups have a strong effect on solubility, so fairly good solvents can often be tolerated for development. If the starting polymer is readily soluble in toluene or benzene, as is usually the case herein, the exposed areas after photooxidation imaging may still be soluble as the imaging does not crosslink or otherwise change such polymer so as to render it completely insoluble in such solvents. It will be recognized that the suitability of particular development solvents will vary with such factors as the molecular weight of polymers in the film substrate, characteristics of other additives or components in the film, desired speed of development, film thickness and strength, etc. The sulfate groups are strongly polar, and therefore to avoid dissolution of the exposed areas, solvent lacking strong polar groups are ordinarily employed. Hydroxy, keto, etc. groups tend to increase the solubility parameter, and therefore not generally used unless with a high solubility parameter polymer system, or if such groups are present in such proportions in the solvent as not to unduly affect the parameter.

For the development of images by dissolution of the exposed sulfated areas, solvents of higher solubility parameter, such as polar solvents, are employed. In broad terms, solvents will dissolve polymers if the solubility parameters match. Thus if a high solubility parameter solvent is used, it can dissolve the sulfated region having a similar solubility parameter, but has too high a parameter to dissolve the non-exposed regions of the polymer. The precise relationship between the number of sulfate groups and the solubility parameter is not shown, but the solvents chosen should have a solubility parameter above that of the original polymer so as not to dissolve non-exposed areas. Polar solvents, such as hydroxyl containing compounds, e.g., various alcohols, glycols, cellosolves, etc. can be used. Solvents will be selected so as to give the desired degree of solubility without unduly affecting the non-exposed area, and may at times have solubility parameters considerably above that of the original polymer substrate. It is to be recognized that the solvents herein can include mixtures of various solvents, and that descriptions herein are mainly concerned with the overall characteristics of solvents, rather than with characteristics of individual components thereof. For example, a particular naphtha may be considered as a low solubility parameter aliphatic hydrocarbon solvent even though it has some aromatics content. With some of the solvents for the sulfated areas it may be desirable to use small amounts of bases, for example, alkalies such as sodium hydroxide, or chemical reagents to aid in the dissolution as the $-SO_3H$ group is acidic, and forming salts may result in solubility.

Another useful guide in choice of development fluids is the KB value. The KB value, i.e., Kauri-butanol value, is a measure of the solvent power of a solvent as determined by dissolving Kauri resin in butanol, and titrating the amount of a given solvent necessary to titrate to incipient insolubility. In general, with hydrocarbons, the stronger the solvent, the higher the KB value. The KB value has a fairly good correlation with solubility parameter for aliphatic solvents. Reported KB values are available for many solvents. When a solvent of particular KB value has been found suitable for developing a particular photosensitive coating, with a particular application method, other solvents of similar KB value will also be suitable. The initial selection can be made by trying solvents on a scale of gradually changing KB value, generally in half-tone work using one which is just sufficiently effective to remove nonexposed areas well, but without disturbing the exposed areas. In the case of mixed solvents of vastly different character, e.g., hydrocarbons and polar solvents, effective KB value must be used, as dependent upon the KB values and relative amounts, as the ordinary method of determining KB values would not give the proper value in such case. With the unsaturated hydrocarbon resins preferred herein, particularly styrene/butadiene polymers, useful KB values are usually in the range of about 32 to 38, or up to 39 to 40 with some application methods.

The latent images obtained herein are at times visible to some extent after the $SO_2$ treatment without further treatment. Moderate heating will generally render the image clearly visible, e.g., as a black or brown image in the exposed areas against a light background. The color of the image can be affected, of course, by pigments or dyes present initially in the photosensitive coating. Heating when used, can, for example, be in the range of 50° to 150° C. or higher for a short time, such as a few seconds up to 5 minutes. The heating apparently causes reactions of the sulfate groups, and of any peroxy groups still present. The images may also develop a different background color in non-exposed areas, such as a yellow green color from the porphyrin catalyst or effect of the sulfur dioxide. This background color can ordinarily be removed by treatment with alkaline materials, such as ammonia, with further heating if desired. The ammonia treatment may lighten the exposed area changing it to a brown from black.

The sulfated photoimages and procedures described herein can be utilized in the photoimaging and transfer procedures described in my copending application Serial No. 119,911 filed March 1, 1971, and can be employed as described therein for preparation of four-color composite pictures or for other purposes. In following such procedures, or in the general practice of the present invention, pigments can be employed in the photosensitive coatings. The pigments employed herein can in general be any pigments which have the desired colors. For the most part the pigments will be organic compounds and these are most suitable although inorganic colorants, for example chrome yellows, can also be used. As used herein the term pigment refers to solid, colorant materials which are insoluble, or at least of very limited solubility, in the polymer solvent systems employed in coating and development. The term dye is used to designate colorant materials employed in solution. The pigments as used are generally in very finely divided, nonagglomerated form, such as in ranges up to 0.5 micron, say 0.1 to 0.5 micron, and seldom exceed 1 micron in diameter. The advantage of the small particle size can be seen with reference to obtaining fine resolution, and also for production of thin, smooth coatings. If not already in fine particle size, the pigments should be reduced to such size, and it may be necessary to break up any agglomerates in preparing the coating formulations. The pigment loading will be regulated to give the desired color depth with the particular coating thickness and other factors. However, the pigment also has an effect upon the developability of the coatings as it tends to make the coatings fracture upon washing with appropriate liquids. A 5 to 10% by weight amount of pigment, based on polymer, is usually sufficient for this purpose, and loadings up to the amount the polymer can bind can be employed, but it will generally be convenient to operate in the range of 10 to 50% by weight, base on polymer. If for some reason a particular coating is to have little or no color, and is to be developed by liquid wash, it may be advisable to add some insoluble solids to the coatings for the effect upon developability, the amounts possibly being sufficient to provide 5 to 10% or so of solids, taking any pigments into account as well as any white, colorless, or low-color solids. For example, various amounts of silica or other fillers can be added along with pigments.

In preparing 4-color proofs in accord with the present invention, color separation exposures are formed on photosensitive polymeric coatings on supports. The coated supports are prepared by coating supports with a material comprising polymer, photosensitizer and pigment. Various procedures can be employed for coating the support, but the following exemplifies a suitable procedure. Mastergrinds of pigments are prepared containing in parts by weight, 30 parts pigment solids, 170 parts toluene, 0.2 part of a surfactant and 25 parts of a 20% solution of styrene/butadiene copolymer in benzene. The pigments are ground for a number of hours with ceramic balls. The polymer to be employed is placed in solution as a 20% solution in benzene by rolling pieces of the polymer in benzene on a ball mill. The polymer solution is sensitized by adding sensitizer thereto, e.g. tetraphenylporphin for photooxidation photoimaging. The desired amount of sensitizer can be added dissolved in 60 parts by weight of chloroform which is added to 50 parts of the polymer solution, along with 50 additional parts benzene. Varying amounts of sensitizer can be used, for many applications a suitable amount is 0.25% by weight of tetraphenylporphyrin the total polymer for the yellow, magenta and cyan coatings, and 0.5% for the black coating. Coating slurries are made from the pigment grinds and sensitizer, polymer solution, conveniently by adding the polymer solution slowly with stirring to the pigment grind in a brown bottle, and adding benzene to obtain the desired solids content. The slurries can conveniently be used as 6% solids concentrations (polymer and pigment). Suitable pigment loadings, are, for example, 25 parts per hundred yellow and cyan, and 20 parts per hundred of magneta and black, the parts being by weight on the polymer. It may be desirable to filter the slurry to insure absence of large particles, e.g. through a seven micron opening nylon screen. The coating slurries are then used to coat a support appropriate for transfer, e.g., a release paper. The coating can be accomplished by usual procedures for applying liquid coatings, for example, by using wire wound rods, such as a No. 10 for yellow and cyan, No. 14 for magenta and No. 12 for black. If the coated papers are to be stored before use, they can be faced with another sheet of release paper to prevent damage to the coating.

The color separation exposures are formed on the coated release papers using the appropriate color separation transparency. A 4000 watt pulsed Xenon light can conveniently be used. During the exposure when a photooxidation is involved, the photosensitive coating must have access to oxygen. This can conveniently be provided for by having an air gap between the transparency and the photosensitive surface. For example, the coated support can be held flat on a vacuum plate. The transparency is on top of the coated support and held in register by register pins. The transparency is topped by a glass plate which is supported by spacers 1/2 mil thicker than the transparency. An air stream is then forced between the transparency and the coated support, forcing the transparency against the glass plate, thereby providing uniform spacing from the photosensitive coating, and providing oxygen for the photooxide ion reaction. With the above light coil held 32 inches from the coated film, the flux as measured by a radiometer was $3.2 \times 10^5$ ergs/cm$^2$/sec. Typical exposure times for photooxidation imaging with this flux are 2.5 minutes for yellow and magenta coatings, 2.75 minutes for cyan coatings, and 7 minutes for black coatings.

For development of the images, areas of the image can be selectively removed by treatment with fluids. For negative working, the non-exposed areas are removed. This is generally accomplished by applying a liquid having some affinity for the polymeric coating but not very great solvent power for it, such as an aliphatic hydrocarbon when the polymer is a styrene/butadiene copolymer. For example, a varnish makers and painters naphtha with a KB value of 36 (Skellysolve V) can be used with a styrene/butadiene copolymer. Any type of washing procedure with such fluids can be employed, provided that care is exercised to avoid excessive mechanical stress on the coating. Spraying with the liquid has been found suitable, whether by hand with a nozzle, or mechanically with a gang of nozzles. Spray nozzles can, for exaple, be about 5 inches from the coating and operated from a tank under 25 psi. Passing back and forth before the nozzles for about 20 seconds is usually sufficient. In general the fluids employed in the development step will be liquids. However, materials having the proper affinity for the coating can also be employed in gaseous or vapor form, employing mild heating if desired. The spray nozzles can also employ air or other gases under pressure as an aid in spraying, or various other expedients employed in spraying paints or cleaning solutions. It is also feasible to employ other washing methods, such as immersing or dipping the coatings in the solutions, with mild agitation. This can at times be combined with blotting or wiping dry, although care must be exercised to avoid damaging the image and it is generally advisable to avoid rubbing the coating. In the dipping procedure the wash solvent becomes discolored with the pigment, and presents some redeposition problem, but this can ordinarily be overcome by changing the wash solution in the later stages.

When the image is to be transferred, the support from which the image is to be transferred should have a surface to which the photosensitive coating has low to moderate adherence. Release papers used in casting of plastics in general have suitable surfaces if they can be coated with the photosensitive material. Such papers can have matt, dull, gloss or patent finishes, so long as the proper release properties are present. In paper or other materials, the release properties are generally provided by release or parting agents, such as waxes, silicones, fluorocarbons, metallic stearates, or other soaps, paraffins or other hydrocarbons, e.g., polyethylenes, or inorganic materials such as silica or silicates, e.g., calcium silicate. Such materials can be applied as a solution or suspension in a volatile solvent which evaporates, leaving a film of the release material on the surface. Such materials need not necessarily be acompletely contiguous film as such materials can frequently be effective if incorporated into the body of the support material, as practiced with antiblocking materials in plastics manufacture, or of various agents in paper manufacture. There are a number of proprietary resins. In general such resins, or lower molecular weight materials, having alternating silicon and oxygen atoms, with hydrocarbon substituents on the silicon, have release properties. The series of silicones manufacture by Dow Corning as release agents give release surfaces, including those of the 200 series, e.g., Dow Corning 203 fluid, or Dow Corning 230 Fluid, which is an alkylaryl polysiloxane fluid, or emulsions such as Dow Corning IIV-490 emulsion which is a silicone emulsion prepared from 100,000-centistoke dimethyl polysiloxane fluid. Possibly, the foregoing will be modified, e.g., as Dow Corning No. 23 silicone release coating has its release properties degraded by Dow Corning C-4-2109 release additive. The desirable release coatings will vary somewhat with the properties of the photosensitive coatings employed, the surface properties of the support to which the image is to be transferred, and the development liquids and washing procedure employed. However in general the release surface will have relatively low surface energy so that the developed image can be transferred to the higher surface energy receptive support. At the same time the photosensitive coating has to be sufficiently adherent to the release surface that it is not completely removed therefrom in the washing development. Any surface can be used for the receptive, i.e., transfer support, provided only that the photosensitive coating can be bonded to it. Paper, including paperboard, can be conveniently used for the transfer surface, either as uncoated paper stock, or coated paper. For example, high quality papers, bond paper, etc. are suitable, and in general most papers having a glossy surface. Cast coat, a high quality paper provided by the Abermarle Paper Company is satisfactory. Papers having the usual titanium dioxide, clay and synthetic binder, e.g., styrene-butadiene resin, coatings are suitable. Various other surfaces can be used for transfer surfaces, e.g., plastic films, metals in general, etc. For reasons of economy and convenience, paper surfaces will generally be preferred.

After development, the images can be dried and transferred. When a composite proof is being made, a number of images are separately transferred in register from their supports to a single transfer support, and the images superimposed thereon constituted the composite proof. The transfer is accomplished by contacting the second support with the image, and stripping the original support from the image. Simple lamination procedures can be employed for the contacting, such as pressing the materials together, and, if desired, applying heat. A platen press can conveniently be employed with pressures of the order of 100 to 500 lbs/in$^2$. Heat can conveniently be used by heating the platen upon which the receptive transfer support rests, while the upper platen is cooled by tap water. Temperatures employed will be well below the melting point of the coating materials, but can make the surface more tacky or soften it to promote bonding to the receptive surface. A rubber blanket or other resilient material may be used between the upper platen and the release support to aid in equal distribution of the pressure. For styrene/butadiene copolymer materials, a bottom platen temperature, for example, around 80° C. is satisfactory. A short sojourn under pressure is sufficient, say five seconds or so. The sheets are then cooled and the original support is separated, leaving the image on the receptive transfer support. Ordinarily a clean transfer is obtained and no residue on the release support is observed. At times there may be some residual color left, or even some background color in areas where the coating has been removed by development, but this is ordinarily not harmful as it does not usually transfer. In the transfer the heating is ordinarily very brief and limited. Heating can affect the photoreaction products, e.g., hydroperoxy or sulfate groups, and promote further reactions thereof, or affect the colorants, and this should be taken into consideration when employing heat in the development or transfer steps. In some cases such further efforts may be desirable, but if not, only mild heating conditions should be used. Platen temperatures are usually in the range of 50 to 120° C.

In view of the effectiveness of the sulfate groups in improving resistance to certain solvents, as compared to hydroperoxy groups, the air gap in the photoimaging step can be dispensed with if desired. It is still necessary to have oxygen present for the photooxidation imaging, but sufficient can diffuse to the photosensitive surface for imaging in practical exposure times if sulfur dioxide and ammonia treatments are also employed. In general, however, to insure good results, an air gap or other means of providing oxygen will be employed.

The procedures herein are suitable for producing either continuous tone on half-tone images. The procedures herein involving solvent removal of portions of the coating and subsequent transfer of the developed image are particularly suited to the production of half-tone prints, in procedures which generally involve the transfer of coatings in the form of dot areas.

The procedures herein produce differential film properties, resulting from differential light exposure and consequent differential distribution of sulfate groups, and differential permeability to fluids is among the properties produced. Thus fluids can be passed through a film or coating containing such sulfate groups in imagewise fashion to produce an image on an adjacent substrate or support, by drying, deposition, etching or otherwise. The exposure time or other imaging variables can be adjusted in conjunction with the coating thickness to obtain the desired degree of photooxidation penetrating to the opposite coating surface to define the image and to permit selective passage of fluids through the coating in imagewise manner. In general, fluid permeability can be used herein in the manner taught herein with respect to dye development, those carriers and dyes suitable for development being suitable for selective passage through the photoimaged film. However some dyes can be selectively passed through the film in a suitable carrier to form an image on a support surface, even though the areas of the film itself do not absorb the dye. For example polar and similar fluids, such as alcohols, can be caused to selectively penetrate the sulfated areas of a film. Similarly, non-polar and similar type fluids can be utilized to penetrate the areas which have not been sulfated. The solubility parameters as discussed herein can be used as a general guide, with fluids which are capable of dissolving areas being suitable for passage therethrough. Complete disintegration of the film can be avoided by using only moderate amounts of solvent at a time to achieve penetration and by avoiding mechanical stress, for example by just wiping a small amount of solvent and dye on the film. Moreover, complete solubility of the polymer is not required, but generally only that the polymer in the desired areas sufficiently absorb or be swelled by the fluid to permit penetration therethrough, so the solvents for this purpose may at times be poorer solvents than would be used for development of an image by selective removal of coating areas. The fluids will be selected to give the desired permeability through selected areas in a desired time while not passing through other areas in such time.

In carrying out the present invention there are advantages in utilizing polymer systems which give uniform homogeneous coatings. In particular, solution coatings systems give homogeneous coatings, whereas emulsion or other dispersion systems give coatings in which the coating film is composed of fairly large particles, possibly formed by agglomeration together of polymer molecules. While emulsion coatings can be usefully employed, the solution coatings are definitely preferred. Also it is advantageous to have the photosensitizer well-dispersed in the polymer coating, at least on a horizontal basis to the depth in the film to which photoimaging is desired. This can advantageously be accomplished by incorporating the sensitizer in a good solvent therefor, e.g., chloroform or other solvents for tetraphenylporphin, which is compatible with the solvents used for applying the polymer coating. The solution, of course, refers to the polymer, as the pigments are ordinarily insoluble in the coating solvents, so the pigmented polymer coatings are slurries in a solvent for the polymer.

The sulfated images herein may involve concentrations of $10^{-10}$ sulfate groups per $cm^2$ or greater and perhaps usually is in a range from $10^{-9}$ to $10^{-6}$ sulfates/$cm^2$. The sulfates may be more concentrated on the surface with generally decreasing concentration with depth into the film, e.g., the concentration per $cm^3$ measured for a 5 micron thickness may be about double that measured for a 10 micron thickness, although the relationship is generally a nonlinear curve. If the $10^{-9}$ groups is considered as distributed in a 10 micron thickness, the concentration is $10^{-6}$ groups/$cm^3$, or about $10^{-6}$ groups/gram of film, assuming the film has a density near one. The $10^{-9}$ to $10^{-6}$ groups/$cm^2$ amounts to about 1 sulfate group for every 50,000 carbon atoms in a polymer up to about one sulfate group for every 50 carbon atoms in the polymer. While there will be variances in the degree of desired sulfation with different polymers, the foregoing is largely a matter of the concentration of sulfate groups in the quantity of material (in the 10 micron film), and will be generally valid regardless of the particular polymer. If the film contains non-photooxidizable polymers or other materials, as well as the photooxidizable polymer, the above ratios of sulfate groups can be considered on the basis of the carbon atoms in the total composition, so as to have about $10^{-6}$ to $10^{-3}$ groups per gram of film. While the amount of sulfate groups will generally be within the foregoing ranges, it is to be understood that higher degrees of sulfation can be employed. Also in view of the strong effect of sulfate groups on various properties, and amplification effects, very minute sulfate concentrations can give desired imaging effects.

The photoimaging in the present polymers is due to sulfate groups, and possibly residual hydroperoxy groups, in the coating materials, and hence crosslinking, polymerization and other reactions are not necessary. The preferred polymer systems utilized herein will generally be substantially linear and soluble in such aromatic hydrocarbons as toluene, but the sulfate groups still have a marked effect in crosslinked polymers upon properties amenable to image development.

EXAMPLE 1

A solution of a styrene/butadiene (60/40) block copolymer (Solprene 406) containing 5 mg tetraphenylporphin per gram of polymer was used to draw coatings on a release paper. The coatings were imaged through a step-wedge (Stauffer 21 × 0.15) employing a 1000 watt tungsten halogen light delivering a flux of $1.4 \times 10^5$ erg/$cm^2$/sec. The images were then developed by rolling on a dye solution with a wire-wound rod, and using a squeeze to remove excess after a 2-minute contact. The coating was then transferred to a receptive paper support, and the optical density was measured, employing a red or green filter with a densitometer to measure reflection density. In some of the procedures the dye development was preceded by treatment with an $SO_2$ atmosphere for 30 seconds, and followed by $NH_3$-treatment for 30 seconds. In one procedure a cyan dye was employed for negative working development, and a red filter was used in the density measurement. With a 30 second light exposure, the first step on the step-wedge produced an optical density of 0.46 without the subsequent gas treatments and 0.92 with the $SO_2$ and $NH_3$ treatments; the 0.24 value for the third step without gas treatment compared to 0.24 for the 13th step with the gas treatment. The light transmission through the third step of the step-wedge is 44.7%, compared to only 1.41% through the 13th step. Thus the use of $SO_2$ and $NH_3$ improved, the imaging speed by a factor of about 31. For the development, the dye was a solution of cyan dye, Astra Blue 3R Conc., as a 4% (wt.-volume) solution in a 1 to 1 mixture of 2-ethylisohexanol and ethanol. The step-wedge used had light transmissions varying from 89.1% for the first step, 22.4% for the fifth step, 3.98% for the tenth step, 0.71% for the fifteenth step, and known intermediate values for the other steps. With a one minute exposure and development with crystal violet as a 1% wt/volume solution in a 3:1 mixture of 2-ethylisohexanol and ethanol, the measured optical density (green filter) without gas for the second step exposure was equivalent to that of the 16th step with the $SO_2$ and $NH_3$ treatments, for a factor of about 90. With a 30 second light exposure and a magenta dye (Astra Violet 3RA Extra) as a 4% (wt-volume) solution in 1:1 2-ethylisohexanol and ethanol, the measured optical density (green filter) of the step two exposure without gas treatment was 0.50, the same as the step 12 exposure with $SO_2$ and $NH_3$ treatment. Light transmission through step 2 is 63.1, compared to 1.99 through step 12, for a factor of about 30, i.e., with the gas treatments only about one-thirtieth the exposure is necessary to obtain equivalent optical density.

For a positive working system, a styrene/butadiene 50/50 copolymer was employed in the foregoing procedures, with development by a sudan red dye (Sudan Red O) as a 2% (wt.-volume) solution in kerosene, or a blue dye (Calco Oil Blue V) as a 2% (wt.-volume) solution in kerosene. The dyes solutions are primarily adapted to absorb on non-exposed areas, but optical density is measured to determine the effect of exposure in causing rejection of dye in exposed areas, with higher rejection, i.e., lower optical density, being useful for achieving lower background and greater contrast in reproduction of positives. For a three minute exposure and blue dye development, density values (measured with a red filter) varied from 0.40 for step 1 to 1.40 for step 5, with no gas tretment, while the $SO_2$ and $NH_3$ treatment gave values of 0.28 for step 1, 1.28 for step 5, and 1.35 for step 7, for an amplification factor of about 1.5. With the same exposure, and Sudan red dye, the optical density (green filter) varied from 0.40 for ste 1 to 1.01 for step 5, without gas treatment, and 0.34 for step 1, to 1.04 for step 5 with the $SO_2$ and $NH_3$ treatments, for an amplification factor of about 1.5.

EXAMPLE 2

A paper board was coated with a styrene/butadiene 60/40 latex (Dow 636) to which a 2:1 pigment loading, based on polymer, had been added. The virtually colorless pigment was 9 parts clay to 1 part $TiO_2$. The coating was sensitized by wiping it with a solution of tetraphenylporphin in chloroform, chlorinated paraffins of 40 to 70% chlorine content (Chlorowax, grade 40) and a plasticizer, methylcarbityl benzyl phthalate. The coating was exposed to light through a positive transparency and developed by wiping with a kerosene solution of Sudan Brown dye. The nonexposed areas pick up the dye. A one minute exposure gave a satisfactory picture with good contrast, while a 15 second exposure gave poor contrast because the non-exposed areas picked up some dye. When the light exposure was followed by five minutes treatment with $SO_2$ gas, a 15 to 30 second light exposure was sufficient to produce a picture with good contrast. With a 1 minute light exposure and the $SO_2$ treatment, the resulting picture appeared over-exposed. Substantially equivalent results were obtained when the $SO_2$ treatment preceded the light exposure.

EXAMPLE 3

The sensitized coating used in Exmple 2 was exposed to light through a negative transparency for five minutes, treated with $SO_2$ for 5 minutes, and heated at 120° C for 2 to 3 minutes. A very definite picture was obtained which was black upon a yellow background. The procedure was repeated, but with a chloroform wash before the $SO_2$ treatment. A black picture upon a white background was produced.

EXAMPLE 4

A paper board coated with a styrene/butadiene block copolymer (Kraton 101 marketed by Shell Chemical Company) was sensitized with tetraphenylporphin solution exposed to light through a negative for 15 seconds, then exposed to $SO_2$ gas, and developed by application of polar dye. In an alternate procedure, the coating was exposed to $SO_2$ prior to the light exposure. Both $SO_2$ treatments produced darker pictures than were obtained in controls without the $SO_2$ treatment. Two different dyes were used for the development of separate samples, 2-ethylhexanol solutions of Crystal Violet and Basacryl Red.

EXAMPLE 5

A styrene/butadiene block copolymer coating was sensitized with a tetraphenylporphin solution. The coating was exposes through a stencil for 10 to 15 minutes. The coating was then treated with sulfur dioxide. The light-exposed area was gray to colorless, while the non-exposed area was yellow-green. The coating was heated at about 120° C for 2 minutes to turn the exposed area black, while the non-exposed area was yellow-green. The coating was then contacted with ammonia to gradually lighten the yellow-green area until it disappeared, whiel the black area turned brown. An additional $SO_2$ contact produced the yellow-green color again, but this disappeared upon heating, while the brown color remained in the exposed area. Another sample of the coating was similarly light-exposed and then heated for 1 to 2 minutes at 120° C. the coating was then contacted with $SO_2$, which turned the non-exposed area a yellow-green, while the exposed area remained colorless. Upon additional heating, the exposed area turned gray, while the on-exposed area remained yellow-green. Any moderate heat can be used in accelerating the effect of the sulfur dioxide, such as 50° to 150° C for a few seconds up to 5 minutes or more, with longer times generaly being used as the heating temperature is lowered.

EXAMPLE 6

A paper board was coated with a styrene/butadiene block copolymer and sensitized with a tetraphenylporphin solution of tetraphenylporphin. The solution contained 500 mg. tetraphenylporphin, 70 grams chloroform, 30 grams chlorinated paraffin and 70 grams plasticizer, methylcarbityl benzyl phthalate. The sensitized coating was exposed to light through a negative transparency, and developed by wiping with a solution of Crystal Violet in 2-ethylhexanol. A 1 minute light exposure gave a good, positive picture. A small portion of the above sensitizer solution was placed in a small bottle, filling about one-fourth of its volume, and $SO_2$ gas was added to fill the free space. The solution turned green. When this sensitizer was used with the same styrene/butadiene coating, a 30-second light exposure gave a darker picture than was obtained above, and a 1 minute exposure gave a much darker picture. Thus the addition of $SO_2$ to the sensitizer shortened the light-exposure time necessary to obtain a picture of a given shade. The $SO_2$ apparently forms an adduct with the tetraphenylporphin forming some kind of complex which has limited stability. The pyrrole rings of the porphin contain amino nitrogen. Since it is not necessary to form an adduct with all tetraphenylporphin molecules present, it is not necessary to have one $SO_2$ molecule for each prophin molecule, but such amount, as well as greater or lesser amounts, will be effective. The $SO_2$ groups may then react with the hydroperoxy groups, alone or accompanied by a porphin moiety.

EXAMPLE 7

A photosensitive coating was made from a styrene/-butadiene random copolymer (Solprene 303, Phillips Pet.) of 48 parts styrene to 52 parts butadiene with tetraphenyl porphyrin sensitizer, and a 15 parts per hundred pigment loading, based on polymer. The pigment was a 9 to 1 mixture of cyan and green pigments (Monastral Blue B BT284-D and Monastral Green Y GT 805-D, both available from duPont). The coatings on release paper were exposed through half-tone tints of varying coverage, treated with $SO_2$ gas for 30 seconds, developed by washing with an aliphatic naphtha (Skellysolve V, KB value of 36), treated with ammonia gas for 30 seconds, and transferred to another paper. In an alternative procedure, the ammonia treatment directly followed the $SO_2$ treatment. The light exposure times varied from 15 to 150 seconds, and the sensitizer concentrations from 0.01% to 0.1%, based on polymer. The equivalent dot areas obtained were closer to that of the tints used at the lower ends of the light exposure and sensitizer concentration scales, with a tendency to considerable dot gain at the upper ends of the scale. In general the ammonia treatment before development resulted in greater dot areas than were obtained when the ammonia treatment followed development.

EXAMPLE 8

A styrene/butadiene polymer coated paper board was wiped with a solution of sulfolene in ethanol and sensitized with the tetraphenylporphin solution described in Example 2. The coating was exposed to light through a positive transparency for 1 minute, heated in a 120° C. oven for five minutes, and wiped with a 1% solution of Sudan Brown dye in kerosene. A picture was obtained which was much lighter than one produced in a control procedure with no sulfolene treatment, i.e., the exposed areas picked up less dye when the sulfolene treatment was used, and gave a picture of greater contrast. Similar procedures with 30 second exposures, and adding the sulfolene either before or after the exposure, gave suitable pictures. Sulfolene, $C_4H_6O_2S$, i.e., 2,4-dihydrothiophene-1,1-dioxide, is a sulfone as it has an $SO_2$ moiety.

In accordance with one aspect of the present invention an image can be formed by image-wise exposure in the presence of oxygen of a photosensitive coating comprising a photochemically oxidizable substrate and an oxidation photosensitizer capable of absorbing light energy to effect a transfer of oxygen from the surroundings to form a chemical bond between oxygen and the coating composition, and treating the coating with sulfur dioxide. The image thus formed can be developed by adding coloring materials to selectively color areas, or by selective removal of areas by treatment with liquids. What is claimed is:

1. A coated structure in which the coating bears a latent image comprised of portions containing sulfate groups and portions not containing sulfate groups, in which the differential concentrations of sulfate groups, are dependent upon the degree of light exposure in an imagewise exposure to light, and wherein the sulfate groups are present as substituents on unsaturated polymers represented by the structure

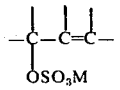

where M represents hydrogen, metal or other moiety capable of forming a salt with the sulfate anion.

* * * * *